US005187841A

United States Patent [19]

Takemura et al.

[11] Patent Number: 5,187,841

[45] Date of Patent: Feb. 23, 1993

[54] PULL TAB FOR SLIDE FASTENER

[75] Inventors: Chiharu Takemura; Yoshiyuki Horita, both of Toyama, Japan

[73] Assignee: Yoshida Kogyo K. K., Tokyo, Japan

[21] Appl. No.: 892,984

[22] Filed: Jun. 3, 1992

[30] Foreign Application Priority Data

Jun. 3, 1991 [JP] Japan ..... 3-72585

[51] Int. Cl.[5] ..... A44B 19/26

[52] U.S. Cl. ..... 24/429; 24/415

[58] Field of Search ..... 24/415, 419, 429, 431

[56] References Cited

U.S. PATENT DOCUMENTS

| | | | |
|---|---|---|---|
| 1,715,976 | 6/1929 | Baker | 24/429 |
| 2,309,140 | 1/1943 | Rod | 24/419 |
| 2,497,740 | 2/1950 | Poux . | |
| 3,641,634 | 2/1972 | Asai | 24/429 |
| 4,790,050 | 12/1988 | Ishii | 24/429 |
| 4,928,358 | 5/1990 | Ishii et al. | 24/431 |
| 4,949,434 | 8/1990 | Minami | 24/429 |
| 4,976,015 | 12/1990 | Ishii | 24/429 |

FOREIGN PATENT DOCUMENTS

| | | |
|---|---|---|
| 60-60912 | 4/1985 | Japan . |
| 62-102407 | 6/1987 | Japan . |
| 1-90407 | 6/1989 | Japan . |

*Primary Examiner*—James R. Brittain

*Attorney, Agent, or Firm*—Hill, Steadman & Simpson

[57] ABSTRACT

A slider pull tab is disclosed for use on a slide fastener applied to and covered by a garment strip. The pull tab has a gripping section including oppositely disposed longitudinal edge portions defining therebetween a web portion which is thinner than the edge portions. One of the edge portions is thicker than the other, presenting such a cross-sectional profile of the gripping section as is conforming with the contour of palmar fingers of the user.

3 Claims, 2 Drawing Sheets

PULL TAB FOR SLIDE FASTENER

BACKGROUND OF THE INVENTION

1. Field of the Invention

This invention relates to a slider for a slide fastener and more particularly a pull tab for manipulating the slider to open and close the fastener.

2. Prior Art

There are known numerous slider pull tabs. These are basically similar in construction and design regardless of whether they are applied to slide fasteners used on ordinary coverless garment articles such as jackets, bags or the like where the slide fastener is exposed to view, or they are applied to slide fasteners used on trouser flies, skirt side flies, covered pockets or the like where the slide fastener is concealed from view. In the latter case where the fly strip is sewn along one edge to the garment, the slider is gripped by fingers inserted through the other edge which is open and pulled in either direction by its pull tab, in which instance the gripping force or pressure tends to vary across the width of the pull tab, fails to act in a direction parallel to a pair of coupling element rows on the fastener and is liable to deflect obliquely with respect to the longitudinal axis of the fastener. This would in turn make the movement of the slider sluggish, resulting in malfunctioned or damaged slide fastener upon repeated forcible opening and closing. Conventional slider pull tabs have a further drawback in that they are prone to become bent or otherwise impaired when the slide fastener is ironed not knowing it is covered by such fly strips as those on trousers, skirts or the like.

SUMMARY OF THE INVENTION

With the foregoing drawbacks of the prior art in view, the present invention seeks to provide a slider pull tab suitable for use with slide fasteners concealed from external view which can be manipulated with a finger pressure applied substantially uniformly across its width so as to maintain smooth slider movement with respect to the slide fastener.

The invention further seeks to provide a slider pull tab which is fool-proof against ironing.

According to the invention, there is provided a pull tab for a slider of a slide fastener applied to and covered by a garment strip, the pull tab having a connecting end portion for pivotal connection to the slider and a free terminal end portion and comprising a gripping section formed by oppositely disposed first and second longitudinal edge portions defining therebetween a web portion which is thinner than the first and second longitudinal edge portions, the first edge portion being thicker than the second edge portion, presenting a cross-sectional profile conforming with the contour of palmar fingers of the user.

The above and other objects and features of the invention will be better understood from the following detailed description taken in conjunction with a preferred embodiment.

DETAILED DESCRIPTION OF THE INVENTION

Figure 1:
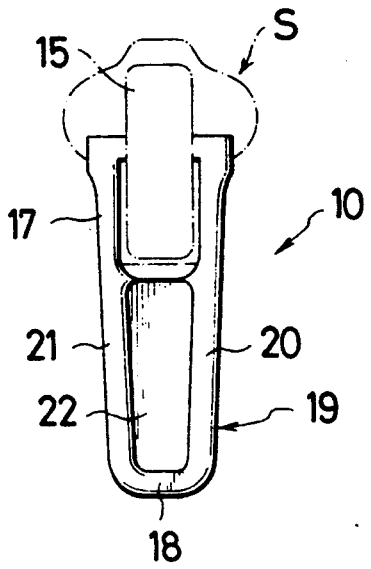
FIG. 1 is a plan view of a pull tab embodying the invention, shown mounted on a slider.
Figure 2:
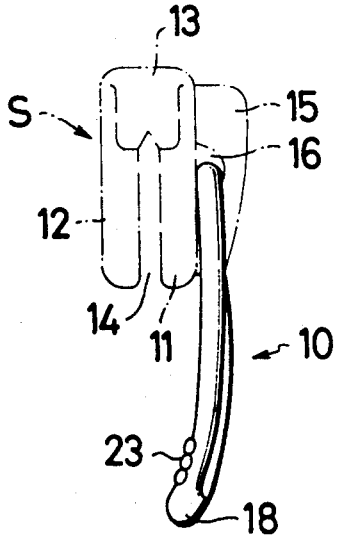
FIG. 2 is a side elevational view of the same.
Figure 4:
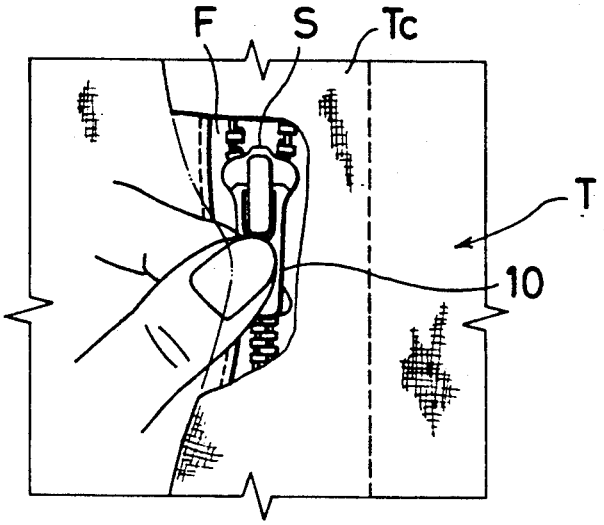
FIG. 4 is a plan view of the pull tab of the slider mounted on a slide fastener attached to a fly strip such as for trousers.
Figure 5:
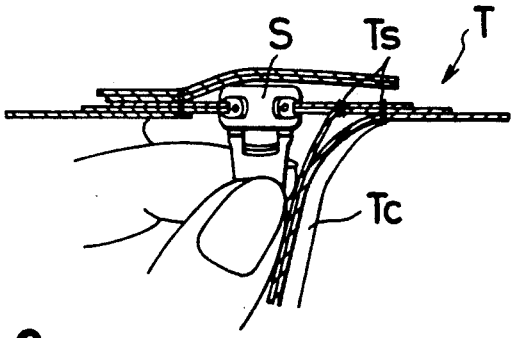
FIG. 5 is an end elevation of the slider shown covered by the fly strip.

Referring now to the drawings and FIGS. 1 and 2 in particular, there is shown a slider pull tab 10 embodying the invention. The pull tab 10 is an integral component part of a slider S which is mounted on and adapted to open and close a slide fastener F (FIG. 4). The slider S comprises a pair of flanged upper and lower wing members 11 and 12 which are connected at one of their ends by a connecting head or diamond 13. A guide channel 14 is defined between the upper and lower wing members 11 and 12 for the passage therethough of a pair of fastener stringers (FIGS. 4 and 5). Designated at 15 is a trunnion having an opening 16 in which to receive the pull tab 10 pivotably in a manner well known in the art.

Figure 3:
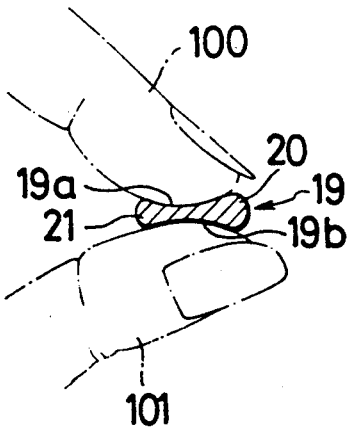
FIG. 3 is a transverse cross-sectional view of the pull tab schematically shown gripped between fingers of the user.

The pull tab 10 provided in accordance with the invention may be made from a metallic or plastics material. It is generally rectangular in shape, having at one end a connecting end portion 17 for pivotal connection to the trunnion 15 of the slider S and at the other end a free terminal end portion 18 which is bent down inwardly for purposes hereinafter described. The pull tab 10 includes a gripping section 19 intermediate between the two end portions 17 and 18 to be gripped or pinched between fingers, usually an index finger 100 and a thumb 101 as illustrated in FIG. 3. The gripping section 19 is formed by oppositely disposed longitudinal edge portions 20 and 21 defining therebetween a central web portion 22 which is slightly warped inwardly.

According to an important aspect of the invention, one of the opposed edge portions 20 and 21 of the gripping section 19 is formed thicker than the other, with the central web portion 22 thinner than the respective edge portions 20 and 21 so as to present a cross-sectional profile conforming with the contour of a palmar finger as shown in FIG. 3.

Figure 6:
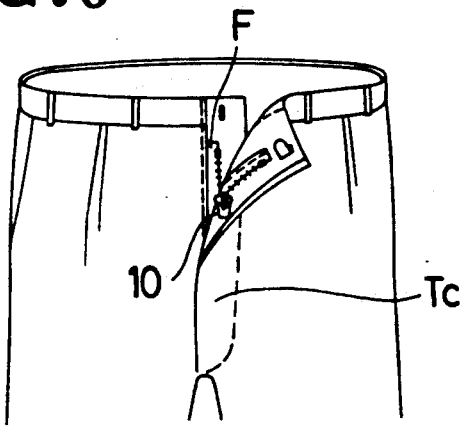
FIG. 6 is a diagrammatic view of a pair of trousers having a slide fastener sewn to their flies.

For purposes of illustration, the slider pull tab 10 is shown applied to a slide fastener F which is sewn by stitchings Ts to trouser flies T and normally concealed from view by a flap cover Tc as depicted in FIGS. 4, 5 and 6 inclusive. When attempting to move the slider S relative to the slide fastener F, the fingers 100 and 101 of the user are inserted from under the flap cover Tc to reach and pull the pull tab 10. In this instance, the thicker edge portion 20 of the pull tab 10 is located adjacent to the inner stitched side of the flap cover Tc so as to ensure uniform distribution of finger pressure over the entire gripping section 19 required to pull the pull tab 10 in a direction substantially parallel to the longitudinal axis of the slide fastener F.

The first thicker edge portion 20 and the second opposite edge portion 21 which is thinner than the first edge portion 20 but thicker than the central web portion 22, respectively project beyond the web portion 22 symmetrically on opposite sides of the gripping section 19, creating symmetrically arcuate surfaces 19*a*, 19*b* conforming with the contour of the palmar side of each of the fingers 100, 101 which will serve to grip the pull tab 10 with uniform finger pressure thereby ensuring proper and smooth operation of the slider S.

Alternatively, the first edge portion 20 may be coextensive with the second edge portion 21 on the front side of the gripping section 19 but projects asymmetrically longer than the second edge portion 21 on the reverse side of the gripping section 19.

As better shown in FIG. 2, the pull tab 10 has its free terminal end portion 18 bent inwardly toward the plane of the slider S and engageable with the coupling elements of the slide fastener F so as to prevent the pull tab 10 from getting flexed or damaged at its connecting end portion 17 which would otherwise occur during ironing of the slide fasteners F.

Designated at 23 is a beaded strip attached to the pull tab 10 adjacent to the free terminal end portion 18 for preventing the fingers of the user from slipping off when gripping the pull tab 10.

Obviously, various modifications and variations of the present invention are possible in the light of the above teaching. It is therefore to be understood that within the scope of the appended claims the invention may be practiced otherwise than as specifically described.

What is claimed is:

1. A pull tab for a slider of a slide fastener applied to and covered by a garment strip, said pull tab having a connecting end portion for pivotal connection to said slider and a free terminal end portion and comprising a gripping section formed by oppositely disposed first and second longitudinal edge portions defining therebetween a web portion which is thinner than said first and second longitudinal edge portions, said first edge portion being thicker than said second edge portion, presenting a cross-sectional profile conforming with the contour of palmar fingers of the user.

2. A pull tab according to claim 1 wherein said free terminal end portion is bent down inwardly.

3. A pull tab according to claim 1 wherein said first and second longitudinal edge portions project beyond said web portion symmetrically on opposite sides of said gripping section.

* * * * *